United States Patent [19]

Kuchler

[11] 4,185,527

[45] Jan. 29, 1980

[54] SLICING MACHINE WITH EXTENSIBLE SLICE TABLE

[76] Inventor: Fritz Kuchler, Klattenweg 4, A 9010 Klagenfurt, Austria

[21] Appl. No.: 901,710

[22] Filed: May 1, 1978

[51] Int. Cl.[2] ..... B26D 4/46

[52] U.S. Cl. ..... 83/88; 83/167; 271/213

[58] Field of Search ..... 83/88, 167; 271/213, 271/216; 198/423, 462

[56] References Cited

U.S. PATENT DOCUMENTS

| | | | |
|---|---|---|---|
| 1,993,586 | 3/1935 | Bech | 83/88 |
| 3,142,323 | 7/1964 | Metzler | 83/23 |

FOREIGN PATENT DOCUMENTS 324874 9/1975 Austria .

*Primary Examiner*—J. M. Meister
*Attorney, Agent, or Firm*—Montague & Ross

[57] ABSTRACT

A slicing machine wherein a succession of slices is deposited at a predetermined location has a table at this location which has a predetermined starting length which is extensible in a predetermined direction to a substantially greater ending length. This table can comprise a plurality of telescoping sections interconnected by abutments so that when the upper and leading section is displaced outwardly it will automatically pull out the underlying sections one at a time to extend the table to a length the multiple of its starting length. The free end of a roll of sheet material may be clipped at the leading edge of the upper table section so that the slices are deposited on this sheet material.

12 Claims, 4 Drawing Figures

SLICING MACHINE WITH EXTENSIBLE SLICE TABLE

FIELD OF THE INVENTION

The present invention relates to a slicing machine. More particularly this invention concerns such a machine set up automatically to deposit a succession of slices at a predetermined location on a table.

BACKGROUND OF THE INVENTION

A slicing machine is known which deposits a succession of slices at a predetermined location on a table which can be moved in a predetermined direction so that, although the slices are always deposited at the same location or in a line at the same location, the table can be stepped so that each slice lies partially uncovered on the table. Such an arrangement is particularly useful when the thus-arrayed slices are thereafter bubble-packed so that the consumer can see the product. This type of arrangement is also useful when an attractive display of the slices, normally of cold cuts, cheese, or the like, is desired.

A substantial difficulty with the known machines is that it is necessary to make up the packages one at a time, or to form a relatively large display of a plurality of distinct arrays of slices. In order to form relatively large packages or arrays, it would be necessary to provide a relatively large depositing table which would increase the overall size of the slicing machine considerably. Since the creation of large packages or large arrays is not frequently necessary, such an increase in size can hardly be justified economically.

OBJECT OF THE INVENTION

It is therefore an object of the present invention to provide an improved machine.

Another object is the provision of a deposition table for a slicing machine which overcomes the above-given disadvantages.

Yet another object is to provide an improved sliding machine which allows relatively large packages or arrays to be made.

SUMMARY OF THE INVENTION

These objects are attained according to the present invention in a slicing machine of the above-described general type which deposits a succession of slices at a predetermined location and wherein the table has a predetermined starting length and is extensible in a predetermined direction to a substantially greater ending length. Means is provided for continuously or stepwise extending this table in this direction from the starting length to the ending length as slices are deposited thereon to form on the table a row of slices extending in this direction or an array of a plurality of columns extending transversely of the displacement direction.

This table can be formed of a single sheet of flexible material which is rolled up or U-shaped so that it can be unrolled or straightened out, normally passing through horizontally extending guides, to increase its length.

In accordance with another feature of this machine the table is formed of a plurality of sections that overlie each other. Thus at least one upper section and at least one lower section are provided so that the upper section can be pulled out, then the lower section, to at least double the starting table length.

The upper table section in such arrangement is directedly connected to the displacement means, normally constituted as a rack that can be displaced in either direction and which is slidable in a guide fixed to the support of the machine. The upper and lower table sections have respective upper and lower abutments engageable after travel of the upper table section through a distance generally equal to the starting length so that it then entrains the lower table section. Furthermore one of these table sections, preferably the upper table section, is formed as a guide in which telescopes the lower table section.

According to yet another feature of this invention a supply of sheet material such as wax paper is provided to one side of the table. The upper section of the table is provided with a clip in which can be secured the free end of this roll of sheet material. Thus as the table is telescoped outwardly the sheet material will be pulled from its roll so that the slices will be deposited on the sheet. Such sheet material may be provided with longitudinally spaced transverse rows of perforations to allow sections to be torn off, each section carrying an array of slices. Furthermore it is possible according to this invention to provide means for severing the sheet material at the roll or supply. Such severing means may be constituted as a pair of blades operable paper-cutter fashion, or a wheel having a sharpened edge drawable across the paper on a track.

SPECIFIC DESCRIPTION

Figure 1:
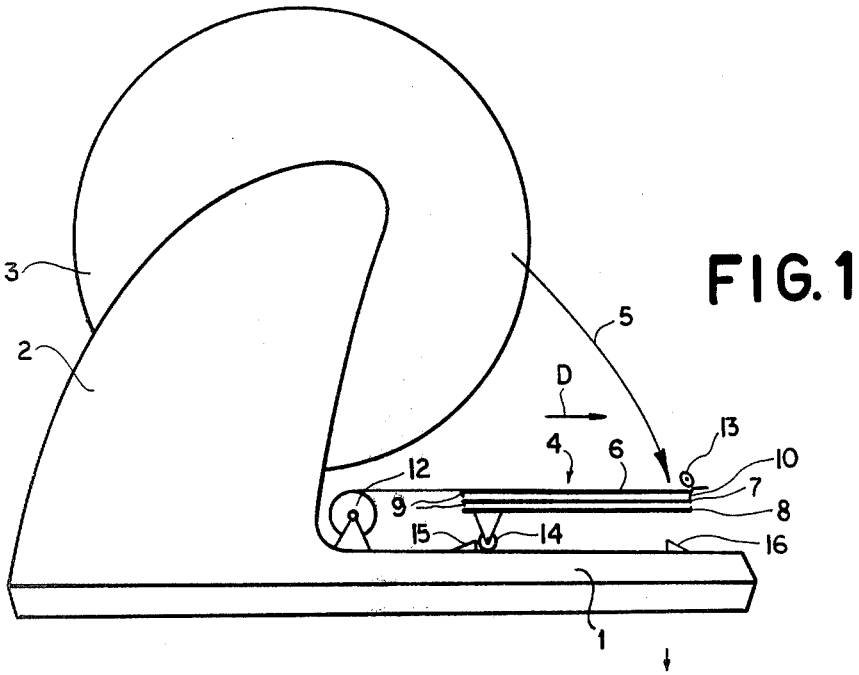
FIG. 1 is a side view of a slicing machine according to this invention.

As shown in FIG. 1 a slicing machine according to this invention basically has a bed 1 having a motor and control-unit housing 2 on which is mounted a rotary blade 3 and equipment that automatically deposits slices in a direction 5 on to a table 4. This type of slicing machine is well known in the art and has automatic equipment that cuts a succession of slices off a workpiece such as a cold cut, and deposits them at a given location on the table 4 in a row extending in the direction z of FIG. 4. The depositing location does not move in the direction x also shown in FIG. 4.

The table 4 in accordance with this invention comprises an upper table section 6, an intermediate table section 7, and a lower table section 8 all having a predetermined length L in the direction x. Each of the table sections 6 and 7 is provided at its trailing end relative to a displacement direction D extending in the direction x with a downwardly extending abutment 9 that can engage an upwardly extending abutment 10 on the leading edge of the table section 7 or 8. In addition each of the table sections 6 and 7 is formed with a bent-over longitudinal edge provided with rollers 11 for telescoping of the underlying table section 7 or 8 in itself.

Figure 2:
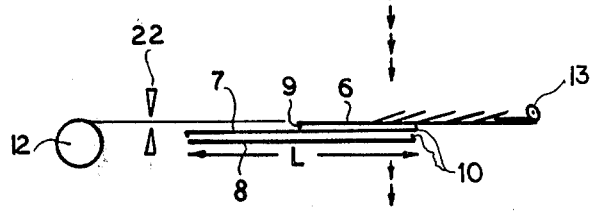
FIGS. 2 and 3 are side views of the depositing table according to this invention in two different working positions.
Figure 3:
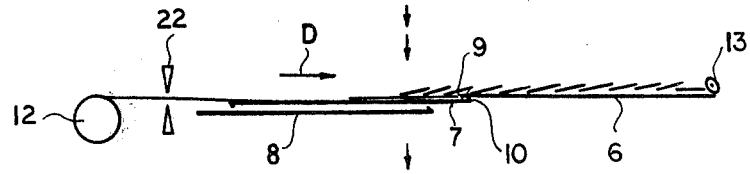

Thus as the upper section 6 is moved in the direction D as shown in FIG. 2 the slices will form an array thereon until the table has moved through a distance equal to the starting length L, whereupon the abutments 9 and 10 of the sections 6 and 7 will engage each other. This engagement will cause the upper section 6 to pull the lower section 7 in the direction D which, after further travel through the distance L, will pull the lower table 8 in the direction D.

The lower table section 8 in turn rides via rollers 14 directly on the bed 1 of the machine and has its end positions defined by upwardly extending stops 15 and 16 seen in FIG. 1.

Figure 4:
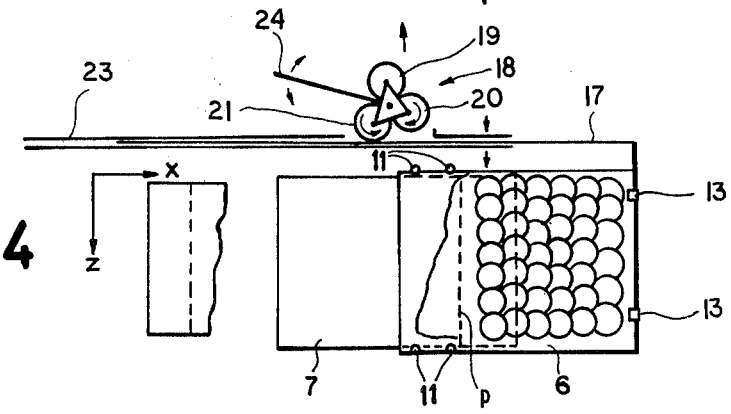
FIG. 4 is a top view of the table in the position of FIG. 2.

In order to facilitate lifting of the rows of slices best seen in FIG. 4 off the machine a clip 13 is provided at the leading edge of the upper section 6. A roll 12 of wax paper is supported downstream of the table 4 and the free end of the paper thereon is engaged in this clip 13, which is constituted as a self-locking eccentric that can be opened up by lifting a small handle. When the handle is released the eccentric swings back to grip the free end of the paper which has been engaged in it. This roll of paper from the supply 12 can be severed by means of a paper-cutting arrangement 22 provided between the supply 12 and the table 4 and perforations such as shown at P in FIG. 4 can be formed in the paper to allow easy tearing-off of sections thereof. As the table sections 6, 7 and 8 are stepped sequentially in the direction D to form an array having an overall length equal to three times the distance L the paper is automatically rolled off the supply 12 in steps.

The table 4 is telescoped out in the manner described above by means of a rack 17 connected to the leading edge of the upper section 6 and extending back in a guide 23 extending in the direction D and x. A reversible gear arrangement 18 serves to displace the rack 17. This arrangement 18 comprises a gear 19 continuously rotated by a belt in one direction and meshing with a gear 20 that in turn meshes with another gear 21. Pivoting of a handle 24 allows either of the gears 20 or 21 to be meshed with the rack 17, and allows both of these gears 20 to 21 to be moved out of engagement with the rack 17. When the gear or pinion 21 is engaged with the rack 17 the table 4 is telescoped out of the direction D, whereas when the arm 24 is pivoted back and the gear 20 is engaged with the rack 17 the table will be telescoped back in the opposite direction into the position of FIG. 1.

It is also within the scope of this invention to form a table of a single flexible sheet of steel or synthetic-resin material. Such an arrangement could use a U-shaped such sheet, or could employ a rolled-up sheet such as the roll 12. Thus the arrangement shown in FIG. 1 could function merely by providing the clip 13 at the forward of the rack 17 in the manner shown, but eliminating the table sections 6 through 8. This would require some tensioning of the sheet material between the roll 12 and the clip 13 as, for instance, by means of a small friction brake.

I claim:

1. In a slicing machine wherein a succession of slices is deposited at a predetermined location, the improvement comprising:

a table at said location having a predetermined starting length and extensible in a predetermined direction to a substantially greater ending length; and means for extending said table in said direction from said starting length to said ending length as slices are deposited on said table to form on said table a row of slices extending in said direction.

2. The improvement defined in claim 1 wherein said table includes an upper table section and a lower table section both substantially of said starting length and slidable together.

3. The improvement defined in claim 2 wherein said upper table section is directly connected to said means.

4. The improvement defined in claim 3 wherein said means includes a rack extending in said direction and connected to said upper table section.

5. The improvement defined in claim 4 wherein said means includes a fixed guide extending in said direction and slidably receiving said rack.

6. The improvement defined in claim 3 wherein said upper and lower table sections have respective upper and lower abutments engageable after travel of said upper table section through a distance generally equal to said starting length to entrain said lower table section.

7. The improvement defined in claim 6 wherein one of said sections is provided with rollers and forms a guide for the other of said sections.

8. The improvement defined in claim 3 wherein said machine includes a fixed support provided with at least one stop limiting displacement of said lower table section in said direction.

9. The improvement defined in claim 3 wherein said machine includes a fixed support, said lower table section being provided with rollers supporting itself on said support for rolling in said direction thereon.

10. The improvement defined in claim 3, further comprising a supply of elongated sheet material adjacent said table and withdrawable in said direction from said supply, and a clip on said upper table section at the leading edge thereof relative to said direction for gripping said sheet material at a free end thereof, whereby on displacement of said upper section in said direction said sheet material is withdrawn from said supply and said slides are deposited thereon.

11. The improvement defined in claim 10 wherein said clip includes an eccentric rotatable holding clamp.

12. The improvement defined in claim 10, further comprising means for severing said sheet material between said table and said supply.

* * * * *